US006106668A

United States Patent [19]

Stromberg et al.

[11] Patent Number: 6,106,668

[45] **Date of Patent: *Aug. 22, 2000**

[54] METHOD FOR FEEDING COMMINUTED FIBROUS MATERIAL

[75] Inventors: C. Bertil Stromberg, Glens Falls; J. W. Chamblee; Bruno S. Marcoccia, both of Queensbury, all of N.Y.; Rolf C. Ryham, Suwanee, Ga.; Erwin D. Funk, Queensbury, N.Y.

[73] Assignee: Ahlstrom Machinery Inc., Glens Falls, N.Y.

[ * ] Notice: This patent is subject to a terminal disclaimer.

[21] Appl. No.: 09/063,429

[22] Filed: Apr. 21, 1998

Related U.S. Application Data

[63] Continuation-in-part of application No. 08/738,239, Oct. 25, 1996, Pat. No. 5,753,075.

[51] Int. Cl.[7] ..... D21C 1/10; D21C 7/06

[52] U.S. Cl. ..... 162/52; 162/56

[58] Field of Search ..... 162/52, 56, 237, 162/246, 17, 18, 19, 57, 68, 242, 243

[56] References Cited

U.S. PATENT DOCUMENTS

| | | | |
|---|---|---|---|
| 4,370,172 | 1/1983 | Gueissaz | 127/1 |
| 5,164,042 | 11/1992 | Lrsen et al. . | |
| 5,277,760 | 1/1994 | Fongen . | |
| 5,476,572 | 12/1995 | Prough . | |
| 5,500,083 | 3/1996 | Johanson . | |

FOREIGN PATENT DOCUMENTS

| | | |
|---|---|---|
| 0 157 279 | 10/1985 | European Pat. Off. . |
| 2 670 512 | 6/1992 | France . |
| WO 97/39178 | 10/1997 | WIPO . |

*Primary Examiner*—Christopher A. Fiorilla
*Attorney, Agent, or Firm*—Nixon & Vanderhye P.C.

[57] ABSTRACT

A system and method for feeding comminuted cellulosic fibrous material such as wood chips to the top of a treatment vessel such as a continuous digester provide enhanced simplicity, operability, and maintainability by eliminating the high pressure transfer device conventionally used in the prior art. Instead of a high pressure transfer device the steamed and slurried chips are pressurized using one or more slurry pumps located at least thirty feet below the top of the treatment vessel and for pressurizing the slurry to a pressure of at least about 10 bar gauge. A return line from the top of the digester may, but need not necessarily, be operatively connected to the one or more pumps and if connected to the pumps the pressure in the return line may be reduced utilizing a pressure reduction valve and/or a flash tank. During pressurized transferring of the slurry from the pumps to a treatment vessel (which may be as little about 10 feet or as much as about a half a mile away) treatment liquid is provided which contains at least some active pumping chemical including sodium hydroxide, sodium sulfide; polysulfide, anthraquinone or their equivalents or derivatives; surfactants, enzymes, or chelants; or combinations thereof. Pseudo-countercurrent circulation of treatment liquids may be provided between stations.

25 Claims, 6 Drawing Sheets

CHIPS
PIC
80
20
81
82
82'
84
85
86
88
89
710
782
788
790
90
92
810
821
822
823
824
825
826
850
851
854
860
886
887
888
889
890
891
892
610
910
911
912
913
914
915
921
922
950
951
960
986
987
988
989
990
991
992

METHOD FOR FEEDING COMMINUTED FIBROUS MATERIAL

CROSS-REFERENCE TO RELATED APPLICATIONS

This application is a continuation-in-part of application Ser. No. 08/738,239 filed Oct. 25, 1996, now U.S. Pat. No. 5,753,075.

BACKGROUND AND SUMMARY OF THE INVENTION

This invention relates to a method and system for feeding comminuted cellulosic fibrous material to a treatment vessel, such as a continuous digester. The invention simplifies and dramatically reduces the number of components needed when compared to the existing art.

U.S. Pat. Nos. 5,476,572, 5,622,598 and 5,635,025 and pending application Ser. No. 08/713,431, filed on Sep. 13, 1996 now U.S. Pat. No. 5,766,418; introduced the first real breakthroughs in the art of feeding comminuted cellulosic fibrous material to a treatment vessel in over forty years. These patents and the application disclose several embodiments, collectively marketed under the trademark Lo-Level™ feed system by Ahlstrom Machinery Inc. of Glens Falls, N.Y., for feeding a digester using a slurry pump, among other components. As described in these patents and application, using such a pump to feed a slurry to a high-pressure transfer device dramatically reduces the complexity and physical size of the system needed, and increases the ease of operability and maintainability. The prior art systems employing a high-pressure transfer device, for example a High-Pressure Feeder as sold by Ahlstrom Machinery Inc., but without such a pump, are essentially unchanged from the systems sold and built since the 1940s and 1950s.

The present invention relates to an even more dramatic improvement to the methods and systems disclosed in the above-mentioned patent and applications. The present invention actually eliminates the need for transfer devices, such as a High-Pressure Feeder, by using high-pressure pumping devices to transfer a slurry of comminuted cellulosic fibrous material directly to a digester.

The reaction of pulping chemicals with comminuted cellulosic fibrous material to produce a chemical pulp requires temperatures ranging between 140–180° C. Since the aqueous chemicals used to treat the material would boil at such temperatures, commercial chemical pulping is typically performed in a pressure-resistant vessel under pressures of at least about 10 bars gauge (approximately 150 psi gauge). In order to maintain this pressure, especially when performing a continuous pulping process, special accommodations must be made to ensure that the pressure is not lost when introducing material to the pressure vessel. In the prior art this was accommodated by what is known in the art as a "High-Pressure Feeder". This feeder is a specially-designed device containing a pocketed rotor which acts as a means for transferring a slurry of material from a low pressure to a high pressure while also acting as a valve for preventing loss of pressure. This complicated and expensive device has long been recognized as an essential component for introducing slurries of comminuted cellulosic material to pressurized vessels, typically at elevated temperatures, especially to continuous digesters.

According to the invention a system which replaces the High-Pressure Feeder—which has been recognized for over forty years as being essential to continuous digesting—is provided, greatly simplifying construction of a pulp mill.

According to one aspect of the present invention a system for producing chemical cellulose pulp from comminuted fibrous cellulose material, such as wood chips, comprises the following components: A steaming vessel in which comminuted fibrous cellulose material is steamed to remove the air therefrom. A superatmospheric pressure vertical treatment vessel having an inlet for a slurry of comminuted cellulose fibrous material at a top portion thereof and an outlet at a bottom portion thereof. And, pressurizing transfer means for pressurizing a slurry of material from the steaming vessel and transferring it to the treatment vessel inlet, the pressurizing transfer means consisting of one or more high pressure slurry pumps located below the top portion of the treatment vessel.

The one or more pumps preferably comprises first and second high pressure slurry pumps connected in series and each having a pressure rating, an inlet and an outlet, the first pump inlet operatively connected to the steaming vessel, the first pump outlet operatively connected to the second pump inlet, and the second pump having a higher pressure rating than the first pump. The slurry pumps may be helical screw centrifugal pumps, double-piston solids pumps, or other similar conventional pumping devices that are capable of pressurizing a slurry having a relatively high percentage of solids to (in one or more stages) a pressure of at least about 5 bar gauge. The pressurizing and transferring may also be effected by an one or more eductors, of conventional construction, driven by a pressurized fluid supply, such as supplied by conventional centrifugal pump.

One typical unit of measure that indicates the relative amount of solids in a slurry containing solids and liquid is the "liquid-to-solids ratio". In this application, this ratio is the ratio of the volume of liquid being transferred to the volume of cellulose, or wood, material being transferred. Typical conventional centrifugal liquid pumps are limited to pumping liquid having a solids content of at most 3%. This 3% solids content corresponds to a liquid-to-solids ratio of about 33. In the slurry pumps of this invention, the liquid-to-solids ratio of the slurry being pumped is typically between 2 and 10, preferably between 3 and 7, and most preferably between 3 and 6. In other words, the slurry pumps of this invention transfer slurries having a much greater solids content than can be handled by a conventional pump.

A liquid return line may be provided from the top portion of the treatment vessel, containing liquid separated from the slurry at the top of the treatment vessel (preferably a continuous digester). The return line may be operatively connected to an inlet or outlet of one of the slurry pumps, either directly or indirectly. Preferably the liquid return line is connected to a pressure reduction means for reducing the pressure of liquid in the return line before the liquid passes to the inlet or outlet of the slurry pump. The pressure reduction means may take a variety of forms, such as a flash tank and/or a pressure control valve in the return line, or other conventional structures for effectively reducing the pressure of liquid in a line while not adversely affecting the liquid. Where a flash tank is utilized the liquid outlet from the flash tank is connected to the inlet to the first slurry pump, and the steam produced by the flash tank may be used in the steaming vessel.

Alternatively, the pressure reduction may be effected, or even avoided, by using an eductor which uses the pressurized return line liquor as its source of pressurized fluid. An eductor may be used in place of or in conjunction with one or more of the slurry pumps, or other devices, to transfer slurry to the digester.

A conventional chute, as well as other optional components, is preferably connected between the steaming vessel and the at least one slurry pump, the steaming vessel being located above the chute and the chute above the at least one slurry pump. The at least one slurry pump is typically located a distance at least 30 feet (about 10 meters) below the top of the digester, and typically more than about 50 feet (about 15 meters) below.

When the high pressure transfer device is eliminated it is desirable to utilize other mechanisms to retain one of the functions of the high pressure transfer device, namely providing pressure relief prevention should an aberrant condition occur, the high pressure transfer device typically preventing backflow of liquid from the digester into the feed system. Pressure relief preventing means according to the present invention are preferably distinct from the at least one slurry pump, although under some circumstances the inlets to or outlets from the slurry pumps may be constructed in a manner so as to provide pressure relief prevention. The pressure relief preventing means may comprise an automatic isolation valve in each of the slurry conduits transferring slurry from the pumps to the top of the treatment vessel and the return line from the treatment vessel, a conventional controller being provided connected to the isolation valves and operating the isolation valves in response to the pressure sensed by a pressure sensor associated with the slurry conduit feeding slurry to the top of the treatment vessel. The pressure relief preventing means may also comprise a check valve in the slurry conduit, and/or a variety of other valves, tanks, sensors, controllers, or like fluidic, mechanical, or electrical components which can perform the pressure relief preventing function.

The invention may also comprise means for augmenting the flow of liquid to the inlet to the second slurry pump, or to any pump or transfer device, such as a liquid line having liquid at a pressure below the pressure at the second slurry pump inlet, a conduit between the liquid line and the inlet, and a liquid pump in the conduit. The liquid line may be the return line from the treatment vessel, and the conduit may be connected directly to the return line. The liquid return line may be connected to a flash tank as described above, and the conduit may be connected to the flash tank liquid outlet.

According to another aspect of the present invention a method of feeding comminuted cellulosic fibrous material to the top of a treatment vessel is provided. The method comprises the steps of: (a) Steaming the material to remove air therefrom and to heat the material. (b) Slurrying the material with a cooking liquor to produce a slurry of liquid and material. And, (c) pressurizing the slurry to a pressure of at least about 5 bar gauge at a location below the top of the treatment vessel (e.g. at least thirty feet below, preferably at least fifty feet below), and transferring pressurized material to the top of the treatment vessel, the pressurizing step consisting of acting on the slurry with one or more high pressure slurry pumps.

The method may comprise the further steps of: (d) returning liquid separated from the slurry at the top of the treatment vessel to the at least one pump; and (e) sensing the pressure of the slurry while being transferred to the top of the treatment vessel, and shutting off the flow of slurry to the top of the treatment vessel and the return of liquid from the top of the vessel if the sensed pressure drops below a predetermined value. There also may be the step (f) of flashing the liquid while returning in the practice of step (d) to produce steam, and using the steam in the practice of step (a).

In an additional embodiment of this invention, the concept of transferring a slurry of chips is extended back to the point where chips are introduced to the mill, that is, the Woodyard. Conventional pulp mills receive their supply of cellulose material, typically hardwood and softwood but other forms of cellulose material as described above may be handled, in various forms. These include as sawdust, as chip, as logs, as long de-limbed trees (that is, "long wood"), or even as complete trees (that is, "whole trees"). Depending upon the source of cellulose of the "wood supply", the wood is typically reduced to chip form so that it can be handled and treated in a pulping process. For example, devices known as "chippers" reduce the long-wood or logs to chips that are typically stored in open chip piles or chip silos. This receipt, handling, and storage of the chips is performed in an area of the pulp mill referred to as the "woodyard". From the Woodyard the chips are typically transferred to the pulp mill proper to initiate the pulping process.

In conventional Woodyards, the chips are stored in silos from which the chips are discharged, typically by means of a rotating or vibrating silo discharge device, to a conveyor. This conveyor is typically a belt-type conveyor which receives the chips and transfers them to the pulping treatment vessels. Since the Woodyard is typically at a distance from the pulping vessels, this conveyor is typically long. Such conveyors may have a length of up to one-half mile. In addition, treatment systems that do not employ the Lo-Level™ feeding system, as marketed by Ahlstrom Machinery and described in U.S. Pat. Nos. 5,476,572, 5,622,598 and 5,635,025 and pending application Ser. No. 08/713,431, require that the conveyor be elevated, typically to a height of at least 100 feet, in order to feed the chips to the inlet of the first pulping vessel. These conveyers, and the structures that support them, are very expensive and contribute a significant cost to the cost of a digester feed system.

In another embodiment of this invention, the concept of transferring a slurry of chips is extended back to the Woodyard. A preferred embodiment of this invention consists of a method of transferring comminuted cellulosic fibrous material to a pulping process, consisting of the following steps: (a) Introducing untreated chips to a first vessel. (b) Introducing slurrying liquid to the first vessel to create a slurry of material and liquid. (c) Discharging the slurry from the vessel to the inlet of at least one pressurizing and transferring device. (d) Pressurizing the slurry in the pressurizing and slurrying device and transferring the slurry to a treatment vessel.

The first vessel is typically a chip storage silo or bin. This bin preferably has a discharge having one-dimensional convergence without agitation or vibration, such as a DIAMONDBACK bin as described in U.S. Pat. No. 5,000,083, though agitation or vibration may be used. This bin may also have two or more outlets which feed two or more transfer devices. This vessel may also be operated at superatmospheric pressure, for example at 0.1 to 5 bar. If the vessel is operated at superatmospheric pressure some form of pressure isolation device must be located at the inlet of the vessel to prevent the release of pressure. This device may be a star-type isolation device, such as a Low-pressure Feeder or Air-lock Feeder as sold by Ahlstrom Machinery, or a screw-type feeder having a sealing capacity as described in co-pending application Ser. No. 08/713,431.

The slurrying liquid may be any source of liquid available in the pulp mill, including fresh water, steam condensate, kraft white, black, or green liquor or sulfite liquor or any other pulping-related liquid. This liquid may be a heated liquid, for example, hot water or steam, having a temperature of between 50 and 100° C. If the vessel is a pressurized vessel, liquid temperatures of over 100° C. may be used.

Though not essential, this liquid may contain at least some active pulping chemical, for example, sodium hydroxide (NaOH), sodium sulfide (Na2S), polysulfide, anthraquinone or their equivalents or derivatives or surfactants, enzymes or chelates, or combinations thereof.

The pressurizing and transferring device of steps (c) and (d) is preferably a slurry pump, or pumps, but many other pressurizing and transferring devices may be used such as the piston-type solids pump or a high-pressure eductor. Preferably, more than one pressurizing and slurrying pump is used to transfer the slurry. These may be two or more slurry pumps, or any combination of slurry pump, piston-type pump, or eductor. This transfer system may also include one or more storage or surge tanks as well as transfer devices. Preferably, the one or more transfer devices include at least one device having de-gassing capability so that undesirable air or other gases may be removed from the slurry. Also, during transfer, the chips may be exposed to some form of treatment, for example, de-aeration or impregnation with a liquid, preferably a liquid containing pulping chemicals, such as those described above. The slurry may also be exposed to at least one pressure fluctuation during transfer, such that the pressure of the slurry is varied from a first pressure to a second, higher pressure, and then to a third pressure which is lower than the second pressure. As described in U.S. Pat. Nos. 4,057,461 and 4,743,338 varying the pressure of a slurry of chips and liquor improves the impregnation of the chips by the liquor. This pressure pulsation may be achieved by varying the outlet pressure of a set of transfer devices in series, or by controlled depressurization of the slurry between pumping.

In another embodiment, the material need not encounter liquid in the vessel, but may have liquid first introduced to it by means of an eductor located in or below the outlet of the vessel. This liquid is preferably pressurized so that the material and liquid form a pressurized slurry of material and liquid.

The treatment vessel of step (d) may typically be a steaming vessel as described above, preferably a DIAMONDBACK steaming vessel. The vessel may also be a storage or surge tank in which the material may be stored prior to treatment. Since the transfer process may require excess liquor that is not needed during treatment or storage, some form of de-watering device may be located between the transfer device and the treatment vessel. One preferred dewatering device is a Top Separator, as sold by Ahlstrom Machinery. This Top Separator may be a standard type or an "inverted" Top Separator. This device may be an external stand-alone-type unit or one that is mounted directly onto the treatment vessel. Preferably, the liquid removed from the slurry by means of the de-watering device is returned to the first vessel or to the transfer devices to act as the slurring liquid. This liquid may also be used where ever needed in the pulp mill. This liquid may be heated or cooled as desired. For example, this liquid may heated by passing it in indirect heat exchange relationship with any heated liquid stream, for example, a waste liquid stream having a temperatures greater than 50° C. This liquid will also typically be pressurized using one or more conventional centrifugal liquid pumps.

In one preferred embodiment the treatment vessel of step (d) is a steaming vessel which feeds one or more transfer devices as described above. Though this system is preferably used in conjunction with a feed system not having a conventional High-pressure Feeder, this system may also be used with a feed system having a High-pressure Feeder.

The method and apparatus for feeding chips from a distant location, for example, a Woodyard, to a pulping process is not limited to chemical pulping processes, but may be used in any pulping process in which comminuted cellulosic fibrous material is conveyed from one location to another. The pulping processes that this invention is applicable to include all chemical pulping processes, all mechanical pulping processes, and all chemi-mechanical pulping or thermal-mechanical pulping processes, for either batch or continuous treatment.

According to another aspect of the invention there is provided a method of feeding wood chips to the top of a treatment vessel comprising the steps of: (a) Steaming the wood chips to remove air therefrom and to heat the material. (b) Slurrying the wood chips with a cooking liquor to produce a slurry of liquid and material. (c) Pressurizing the slurry to a pressure of at least about 5 bar gauge at a location at least thirty feet below the top of the treatment vessel and transferring pressurized wood chips to the top of the treatment vessel, the pressurizing step consisting essentially of acting on the slurry with one or more high pressure slurry pumps. And, (d) during the practice of the transferring step (c), treating the wood chips with polysuflide, anthraquinone or their equivalents or derivatives, surfactants, enzymes, chelants, or combinations thereof.

Where the treatment vessel is upstream of a continuous or batch digester, step (c) is typically practiced downstream of the treatment vessel. There may also be the further step (e), before the continuous or batch digester and substantially immediately after steps (a) and (b), of pressurizing the slurry at a location at least 30 feet below the top of the digester, and transferring pressurized wood chips to the top of the digester, the pressurizing step consisting of acting on the slurry with one or more high pressure slurry pumps. There may also be the step of returning liquid removed from the digester to the treatment vessel, and adjusting the temperature of the liquid while returning it to the treatment vessel. The step of removing liquid from the treatment vessel typically takes place at the top of the treatment vessel.

The method may also comprise the further step of returning liquid from downstream of the treatment vessel to the treatment vessel, and adjusting the temperature of the liquid, and the step of adjusting the temperature of the liquid may take place by passing the liquid through an indirect heat exchanger. The method may also comprise the further step of returning liquid separated from the slurry at the top of the digester to the one or more slurry pumps, pressurizing the slurry to transfer it to the digester, and adjusting the temperature of the removed liquid during recirculation.

This invention not only reduces the size and cost of the system for transferring comminuted cellulosic fibrous material, but if the comminuted cellulosic fibrous material is treated during transfer, the number and size of the formal treatment vessels may be reduced. For example, this system may eliminate the need for conventional pretreatment or impregnation vessels prior to the digester. This system also has the potential for improving the over-all energy economy of the pulp mill. This and other aspects of the invention will become manifest upon review of the detailed description and figure below.

According to another aspect of the present invention a method of treating comminuted cellulosic fibrous material using at least first and second series connected pumps, and at least first and second in series stations each with a solids/liquid separator. The method comprises the steps of: (a) Pumping a slurry of comminuted cellulosic fibrous material using the series connected pumps. (b) Separating some liquid from the slurry at each station to substantially isolate liquor circulations and streams, and to recirculate removed liquid from at least one of the stations to upstream of one of the pumps. And (c) adding chemicals to the slurry upstream of each of the pumps, the chemicals including at least some chemical selected from the group consisting essentially of sodium hydroxide, sodium sulfide; polysulfide, anthraquinone, or their equivalents or derivatives; surfactants, enzymes, or chelants; or combinations thereof; so that pre-treatment of the material occurs during transfer of the material from each pump to each station.

There may be the further step of degassing the slurry at at least one of the stations. At least first, second and third series connected pumps and stations may be provided; and there may also be the further steps of: (d) Circulating liquid removed from the third station to a location upstream of the second pump, and (e) circulating liquid removed form the second station to a location upstream of the first pump (step (d) may be practiced downstream of the first station). There may also be the further step of passing the removed liquid, during the practice of at least one of steps (d) and (e), through a heat exchanger to change the temperature thereof at least about 5 degrees C.

Step (c) may be practiced by adding a different chemical, or combination of chemicals, upstream of each pump, so that significantly different treatments of the material of the slurry take place during transfer of the slurry from each pump to its associated station. Step (a) may be practiced to pressurize the slurry to a pressure of at least 5 bar. Also, there may be the further step of removing liquid from at least one of the stations through an eductor (also known as an ejector) instead of a flash tank and/or control valve.

According to another aspect of the present invention a method of treating comminuted cellulosic fibrous material is provided comprising the steps of: (a) Pumping a slurry of comminuted cellulosic fibrous material using the at least first and second series connected pumps. (b) Separating some liquid from the slurry at each station to substantially isolate liquor circulations and streams, and to recirculate removed liquid from at least one of the stations to upstream of one of the pumps. (c) Adding treatment chemical to the slurry upstream of at least one of the pumps so that pre-treatment of the material occurs during transfer of the material from that pump to its associated station. And (d) circulating liquid removed form the second station to a location upstream of the first pump. Where at least first, second and third pumps and stations are provided, there is the further step (e) of circulating liquid removed from the third station to a location upstream of the second pump. The details of the steps, or additional steps, may be as set forth above.

It is the primary object of the present invention to provide a simple and effective system and method for feeding cellulose slurry to a treatment vessel, and also while achieving enhanced operability and maintainability. This and other objects of the invention will become clear from an inspection of the detailed description of the invention and from the appended claims.

DETAILED DESCRIPTION OF THE DRAWINGS

Figure 1:
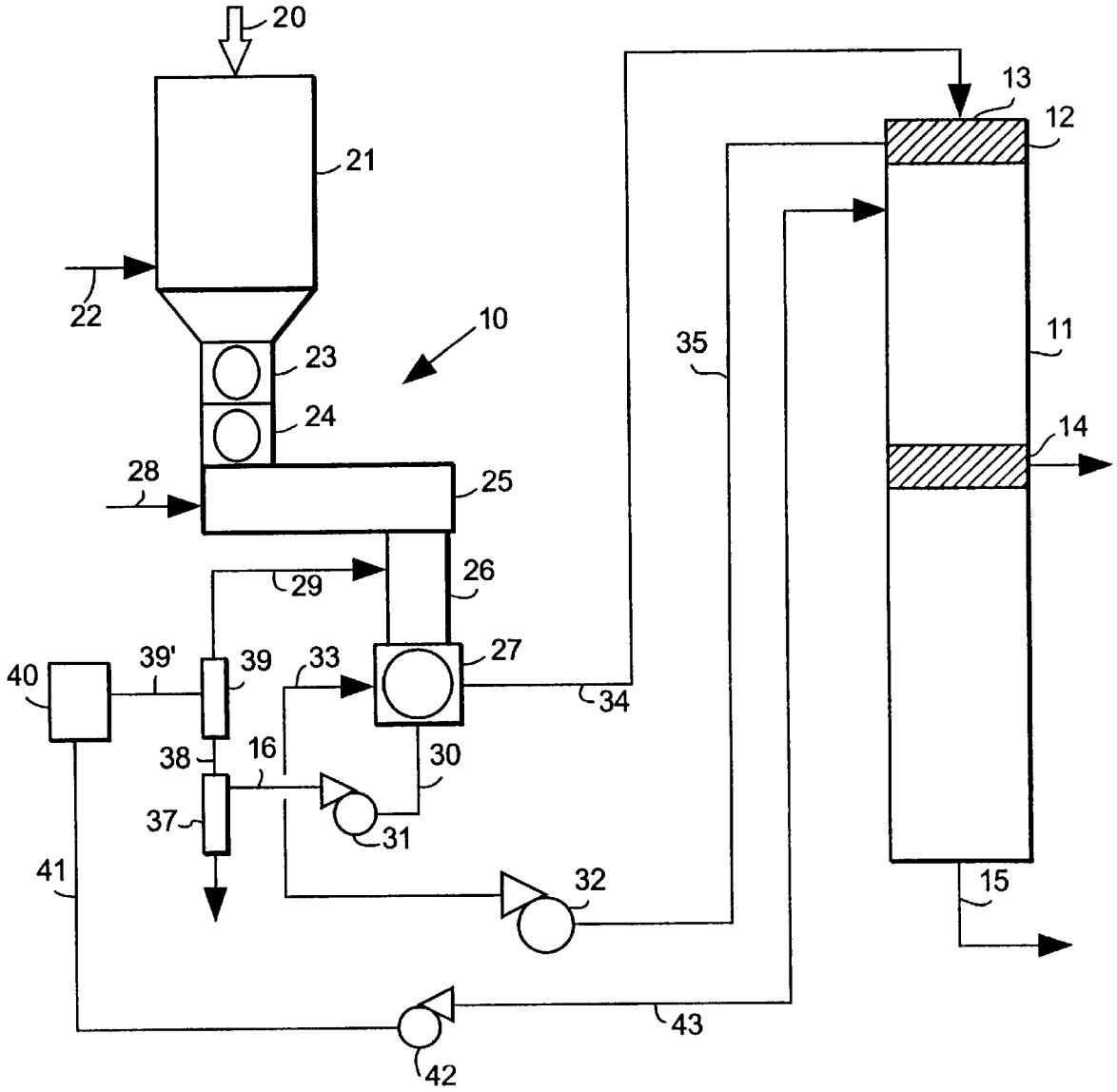
Fig. 1 (Prior Art)
FIG. 1 illustrates a typical prior art system for feeding a slurry of comminuted cellulosic fibrous material to a continuous digester.
Figure 2:
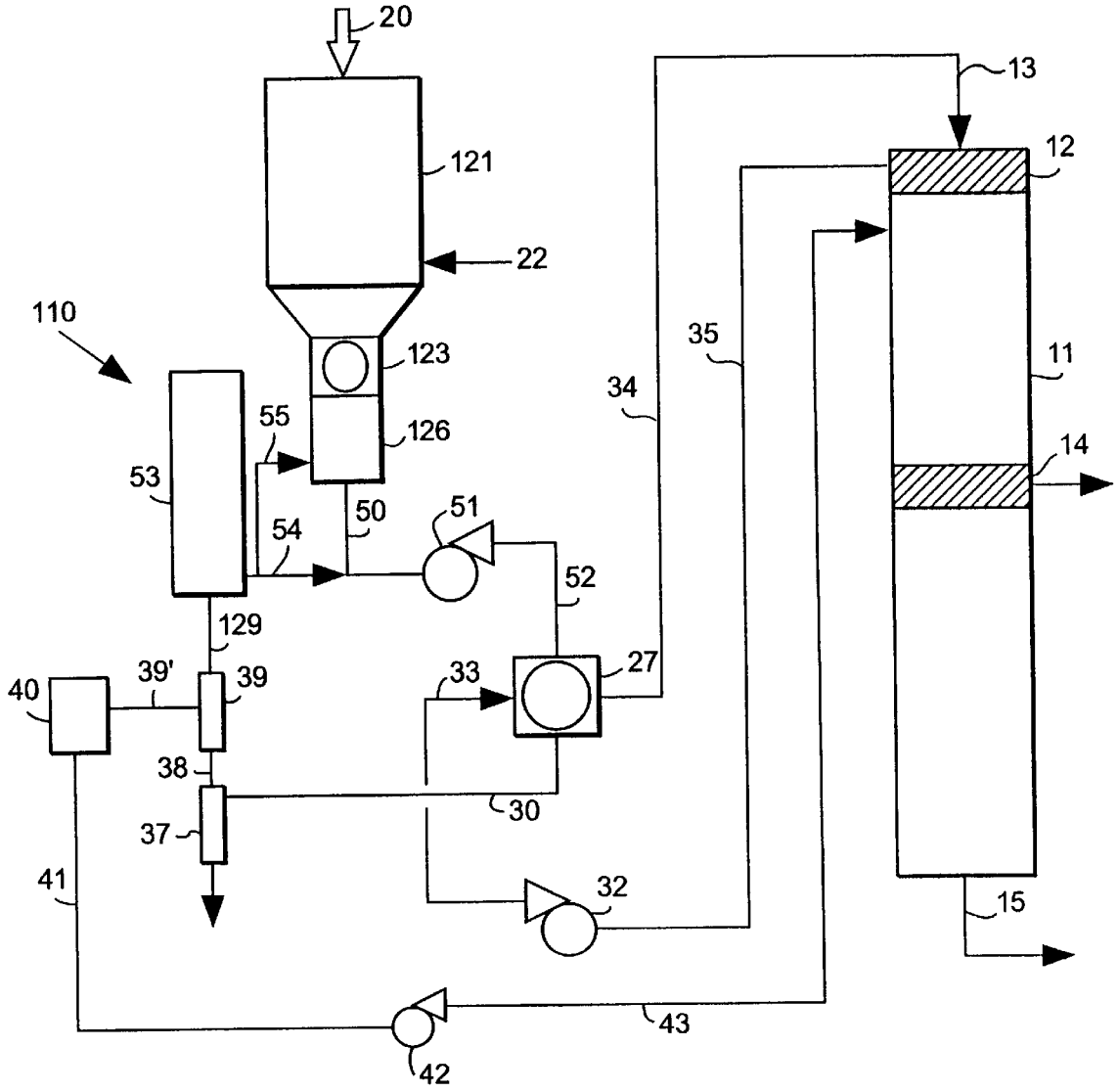
Fig. 2 (Prior Art)
FIG. 2 illustrates another prior at system for feeding a slurry of comminuted cellulosic fibrous material to a continuous digester.
Figure 3:
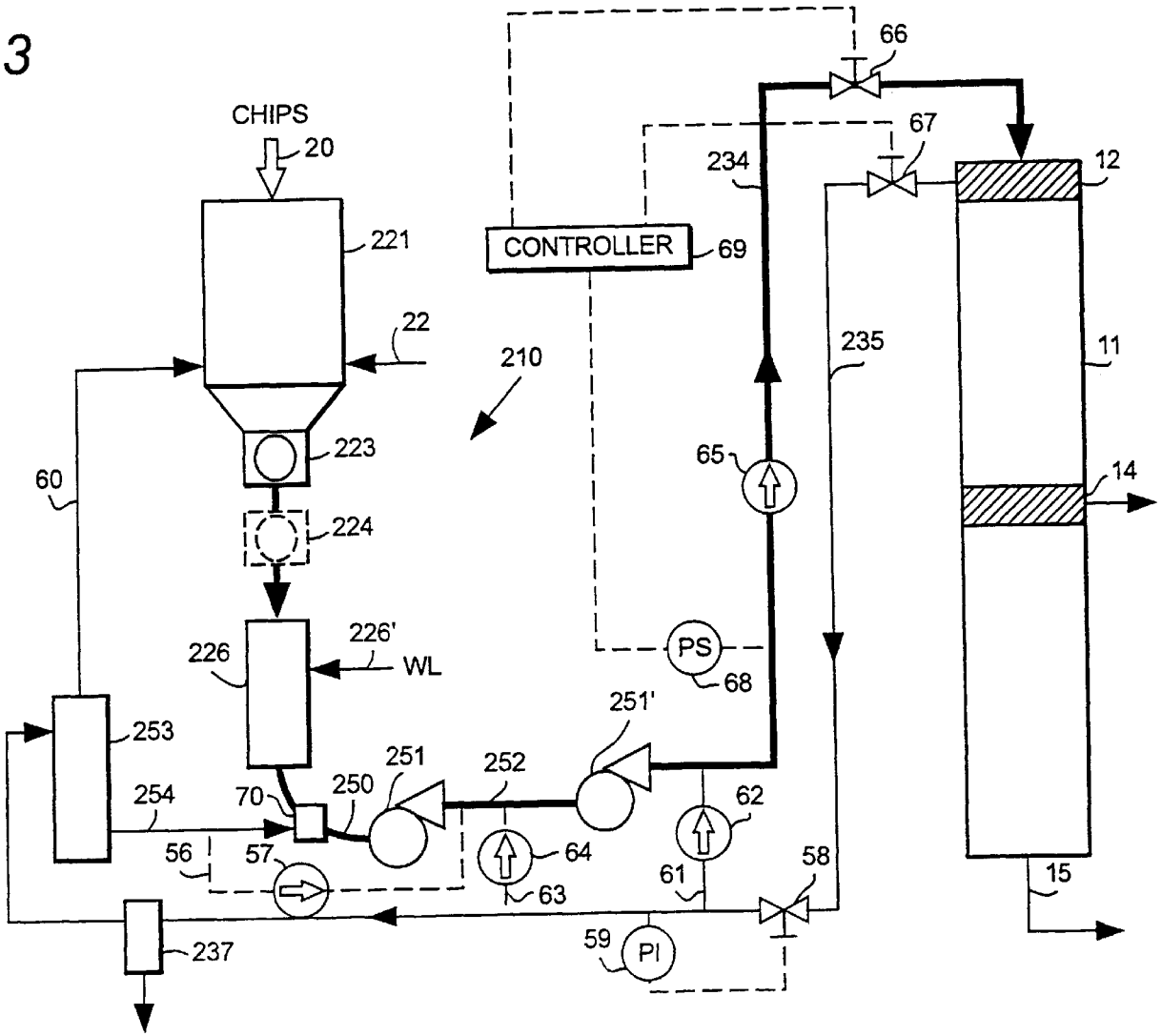
FIG. 3 illustrates one typical embodiment of a system for feeding a slurry of comminuted cellulosic fibrous material to a continuous digester according to this invention.

Though the systems shown and described in FIGS. 1–3 are continuous digester systems, it is understood that the method and system of the present invention can also be used to feed one or more batch digesters, or an impregnation vessel connected to a continuous digester. The continuous digesters shown and which may be used with this invention are preferably KAMYR® continuous digesters, and may be used for kraft (i.e., sulfate) pulping, sulfite pulping, soda pulping or equivalent processes. Specific cooking methods and equipment that may be utilized include the MCC®, EMCC®, and Lo-Solids® processes and digesters marketed by Ahlstrom Machinery Inc. Strength or yield retaining additives such as anthraquinone, polysulfide, or their equivalents or derivatives may also be used in the cooking methods utilizing the present invention.

FIG. 1 illustrates one typical prior art system 10 for feeding a slurry of comminuted cellulosic fibrous material, for example, softwood chips, to the top of a continuous digester 11. Digester 11 typically includes one liquor removal screen 12 at the inlet of the digester 13 for removing excess liquor form the slurry and returning it to feed system 10. Digester 11 also includes at least one liquor removal screen 14 for removing spent cooking liquor during or after the pulping process. Digester 11 also typically includes one or more additional liquor removal screens (not shown) which may be associated with cooking liquor circulation, such as an MCC®, EMCC® digester cooking circulation, or a Lo-Solids® digester circulation having a liquor removal conduit and a dilution liquor addition conduit. Cooking liquor, for example, kraft white, black, or green liquor, may be added to these circulations. Digester 11 also includes an outlet 15 for discharging the chemical pulp produced which may be passed on to further treatment such as washing or bleaching.

In the prior art feed system 10 shown in FIG. 1, comminuted cellulosic fibrous material 20 is introduced to chip bin 21. Typically, the material 20 is softwood or hardwood chips but any form of comminuted cellulosic fibrous material, such as sawdust, grasses, straw, bagasse, kenaf, or other forms of agricultural waste or a combination thereof, may be used. Though the term "chips" is used in the following discussion to refer to the comminuted cellulosic fibrous material, it is to be understood that the term is not limited to wood chips but refers to any form of the comminuted cellulosic fibrous materials listed above, or the like.

The chip bin 21 may be a conventional bin with vibratory discharge or a DIAMONDBACK® steaming vessel, as described in U.S. Pat. No. 5,500,083 and sold by Ahlstrom Machinery Inc., having no vibratory discharge but having an outlet exhibiting one-dimensional convergence and side relief. The bin 21 may include an airlock device at its inlet and a means for monitoring and controlling the level of chips in the bin and a vent with an appropriate mechanism for controlling the pressure within the bin. Steam, either fresh or steam produced from the evaporation of waste liquor (i.e., flashed steam), is typically added to bin 21 via one or more conduits 22.

The bin 21 typically discharges to a metering device, 23, for example a Chip Meter sold by Ahlstrom Machinery, but other forms of devices may be used, such as a screw-type metering device. The metering device 23 discharges to a pressure isolation device 24, such as a Low-Pressure Feeder sold by Ahlstrom Machinery. The pressure isolation device 24 isolates the pressurized horizontal treatment vessel 25 from the essentially atmospheric pressure that exists above device 24.

Vessel 25 is used to treat the material with pressurized steam, for example steam at approximately 10–20 psig. The vessel 25 may include a screw-type conveyor such as a Steaming Vessel sold by Ahlstrom Machinery. Clean or flashed steam is added to the vessel 25 via one or more conduits 28.

After treatment in vessel 25, the material is transferred to a high-pressure transfer device 27, such as a High-Pressure Feeder sold by Ahlstrom Machinery. Typically, the steamed material is transferred to the feeder 27 by means of a conduit or chute 26, such as a Chip Chute sold by Ahlstrom Machinery. Heated cooking liquor, for example, a combination of spent kraft black liquor and white liquor, is typically added to chute 26 via conduit 29 so that a slurry of material and liquor is produced in chute 26.

If the prior art system of FIG. 1 does employ a DIAMONDBACK® steaming vessel as disclosed in U.S. Pat. No. 5,000,083, which produces improved steaming under atmospheric conditions, the pressurized treatment vessel 25 and the pressure isolation device 24 may be omitted.

The conventional High-Pressure Feeder 27 contains a low pressure inlet connected to chute 26, a low pressure outlet connected to conduit 30, a high-pressure inlet connected to conduit 33, a high-pressure outlet connected to conduit 34, and a pocketed rotor driven by a variable-speed electric motor and speed reducer (not shown). The low pressure inlet accepts the heated slurry of chips from chute 26 into a pocket of the rotor. A screen in the outlet, at 30, of the feeder 27 retains the chips in the rotor but allows the liquor in the slurry to pass through the rotor to be removed via conduit 30 and pump 31. As the rotor turns the chips that are retained within the rotor are exposed to high pressure liquid from pump 32 via conduit 33. This high-pressure liquor slurries the chips out of the feeder and passes them to the top of digester 11 via conduit 34. Upon reaching the inlet of digester 11 some of the excess liquor used to slurry the chips in conduit 34 is removed from the slurry via screen 12. The excess liquor removed via screen 12 is returned to the inlet of pump 32 via conduit 35. The liquor in conduit 35, to which fresh cooking liquor may be added, is pressurized in pump 32 and passed in conduit 33 for use in slurrying the chips out of feeder 27. The chips that are retained by the screen 12 pass downwardly in the digester 11 for further treatment.

The liquor removed from feeder 27 via conduit 30 and pump 31 is recirculated to the chute 26 above the feeder 27 via conduit 36, sand separator 37, conduit 38, in-line drainer 39 and conduit 29. Sand separator 37 is a cyclone-type separator for removing sand and debris from the liquor. In-line drainer 39 is a static screening device which removes excess liquor from conduit 38 and passes it through conduit 39' and stores it in level tank 40. Liquor stored in tank 40 is returned to the top of the digester via conduit 41, pump 42 (i.e., the Make-up Liquor Pump), and conduit 43. Fresh cooking liquor may also be added to conduits 41 or 43.

FIG. 2 illustrates another prior art system 110 for feeding chips to a digester. This system uses processes and equipment described in U.S. Pat. Nos. 5,476,572, 5,622,598 and 5,635,025. This equipment and the processes they are used to effect are collectively marketed under the trademark Lo-Level™ by Ahlstrom Machinery. The components in FIG. 2 which are identical to those that appear in FIG. 1 are identified by the same reference numbers. Those components which are similar or which perform similar functions to those that appear in FIG. 1 have their reference numbers that appear in FIG. 1 prefaced by the numeral "1".

Similar to the system of FIG. 1, chips 20 are introduced to steaming vessel 121 where they are exposed to steam introduced via conduit 22. The vessel 121 discharges to metering device 123, and then to conduit 126, which is preferably a Chip Tube as sold by Ahlstrom Machinery. Cooking liquor is typically introduced to tube 126 via conduit 55, similar to conduit 29 of FIG. 1. Since the vessel 121 is preferably a DIAMONDBACK® steaming vessel as described in U.S. Pat. No. 5,000,083, no pressure isolation device, 24 in FIG. 1, or pressurized steaming vessel 25 in FIG. 1, are needed in this prior art system. As disclosed in U.S. Pat. No. 5,476,572 instead of discharging the slurry of chips and liquor directly to feeder 27, a high-pressure slurry pump 51 fed by conduit 50 is used to transport the chips to the feeder 27 via conduit 52. The pump 51 is preferably a Hidrostal pump as supplied by Wemco, or similar pump supplied by the Lawrence company. The chips that are passed via pump 51 are transported to digester 11 by feeder 27 in a manner similar to what was shown and described with respect to FIG. 1.

In addition to using the pump 51 to pass the slurry to the feeder 27, the system of FIG. 2 does not require the pump 31 of FIG. 1. Pump 51 supplies the motive force for passing liquor through the feeder 27, through conduit 30, sand separator 37, in-line drainer 39, and conduit 129 to liquor level tank 53.

The function of level tank 53 is disclosed in pending application Ser. No. 08/428,302, filed on Apr. 25, 1995. The tank 53 ensures a sufficient supply of liquor to the inlet of the pump 51, via conduit 54. This tank may also supply liquor to tube 126 via conduit 55. This liquor tank 53 also allows the operator to vary the liquor level in the feed system such that, if desired, the liquor level may be elevated to the metering device 123 or even to the bin 121. This option is also described in pending application Ser. No. 08/354,005, filed on Dec. 5, 1994.

FIG. 3 illustrates one preferred embodiment of a feed system 210 of the present invention that simplifies even further the prior art feeding systems shown in FIGS. 1 and 2. In the preferred embodiment shown in FIG. 3, the high-pressure transfer device, component 27 of FIGS. 1 and 2, has been eliminated. Instead of transferring chips to the feeder 27 by means of gravity in chute 26 of FIG. 1 or via pump 51 in FIG. 2, at least one, preferably two, high-pressure slurry pumps 251, 251' are used to transport the slurry to the inlet of the digester 11. The components in FIG. 3 which are essentially identical to those that appear in FIGS. 1 and 2 are identified by the same reference numbers. Those components which are similar or which perform similar functions to those that appear in FIGS. 1 and 2 have their reference numbers that appear in FIGS. 1 and 2 prefaced by the numeral "2".

Similar to the procedure in FIGS. 1 and 2, according to the present invention, chips 20 are introduced to steaming vessel 221. The chips are preferably introduced by means of a sealed horizontal conveyor as disclosed in pending application Ser. No. 08/713,431, filed on Sep. 13, 1996. Also, the steaming vessel 221 is preferably a DIAMONDBACK® steaming vessel as described in U.S. Pat. No. 5,000,083 to which steam is added via one or more conduits 22. The steaming vessel 221 typically includes conventional level monitoring and controls as well as a pressure-relief device (not shown). Vessel 221 discharges steamed chips to metering device 223, which, as described above, may be a pocketed rotor-type device such as a Chip Meter or a screw-type device.

In one embodiment of this invention the metering device 223 discharges directly to conduit or chute 226. However, in an optional embodiment, a pressure isolating device, such as a pocketed rotor-type isolation device, shown in dotted line at 224, for example a conventional Low-pressure Feeder, may be located between metering device 223 and chute 226. Though without the pressure-isolation device 224 the pressure in chute 226 is essentially atmospheric, with a pressure isolation device 224 the pressure in chute 226 may range from 1 to 50 psig, but is preferably between 5 to 25 psig, and most preferably between about 10 to 20 psig. Cooking liquor, as described above, is added to chute 226 (see line 226' in FIG. 3) so that a slurry of chips and liquor is produced in chute 226 having a detectable level (not shown). The slurry in chute 226 is discharged via radiused outlet 250 to the inlet of pump 251. The introduction of slurry to the inlet of pump 251 is typically augmented by liquor flow from liquor tank 253 via conduit 254 as described in pending application Ser. No. 08/428,302.

Pump 251 is preferably a centrifugal high-pressure, helical screw, slurry pump, such as a "hidrostal" pump supplied by Wemco of Salt Lake City, Utah. The pump 251 may alternatively be a slurry pump supplied by the Lawrence Company of Lawrence, Mass. The pressure at the inlet to pump 251 may vary from atmospheric to 50 psig depending upon whether a pressure isolation device 224 is used.

In the preferred embodiment illustrated in FIG. 3, the outlet of pump 251 discharges to the inlet of pump 251'. Pump 251' is preferably the same type of pump as pump 251 but with the same or a higher pressure rating. If two pumps are used, the pressure produced in the outlet of pump 251' typically ranges from 150 to 400 psig (i.e., 345–920 feet of water, gauge), but is preferably between about 200 and 300 psig (i.e., 460–690 feet). If necessary, the liquor in the slurry in conduit 252 may be augmented by liquor from tank 253 via conduit 56 and liquid pump 57.

Though the embodiment illustrated in FIG. 3 includes two pumps, only one pump, or even three or more pumps, in series or parallel, may alternatively be used. In these cases, the discharge pressure from the one pump, or from the last pump, is preferably the same as the discharge pressure from pump 251' above.

The pressurized, typically heated, slurry is discharged from pump 251' to conduit 234. Conduit 234 passes the slurry to the inlet of continuous digester 11. Excess liquor in the slurry is removed via screen 12 as is conventional. The excess liquor is returned to the feed system 210 via conduit 235, preferably to liquor tank 253 for use in slurrying in conduit 250 via conduit 254. The liquor in conduit 235 may be passed through a sand separator 237 if desired. This sand separator 237 may be designed for pressurized or unpressurized operation depending upon the mode of operation desired.

Unlike the prior art systems employing a High-Pressure Feeder (27 in FIGS. 1 and 2) which uses the pressure of the liquor returned via conduit 35 as an integral part of the method of slurrying from the High-Pressure Feeder to the digester 11, it is not essential for the operation of the present invention that the pressurized recirculation 235 be returned to the inlet of the pumps 251, 251'. The energy available in the pressure of the flow in line 235 may be used wherever necessary in the pulp mill. However, in a preferred embodiment, the present invention does utilize the pressure available in conduit 235 to minimize the energy requirements of pumps 251 and 251' as much as possible.

How the pressure in return line 235, typically about 150 to 400 psig is used depends upon the mode of operation of the feed system 210. If vessel 226 is operated in an unpressurized—essentially atmospheric—mode, the pressurized liquor returned in conduit 235 must be returned to essentially atmospheric pressure before being introduced to conduit 250. One means of doing this is to use a pressure control valve 58 and a pressure indicator 59 in conduit 235. The opening in valve 58 is controlled such that a predetermined reduced pressure exists in line 235 downstream of valve 58. In addition, the liquor tank 253 may be designed so that it acts as a "flash tank" so that the hot pressurized liquor in conduit 235 is rapidly evaporated to produce a source of steam in vessel 253. This steam can be used, among other places, in vessel 221 via conduit 60. However, instead, in a preferred embodiment, the pressurized liquor in conduit 235 is used to augment the flow out of pump 251', for example via conduit 61 and pump 62. The pressure in conduit 235 may also be used to augment the flow between pumps 251 and 251' in conduit 252 via conduit 63, with or without pump 64 (a check valve may in some cases be used in place of or in addition to each of pumps 62, 64). By re-using some of the pressure available in line 235, some of the energy requirements of pumps 251 and 251' may be reduced.

Also, the heat of the liquor in line 235 can also be passed in heat-exchange-relationship with one or more other liquids in the pulp mill that need to be heated.

The pressurizing and transferring of pumps 251 and 251' may instead by effected by a conventional eductor, for example, an eductor manufactured by Fox Valve Development Corporation. Or pumps 251, 251' may be used in conjunction with an eductor for increasing the pressure in the inlet or outlet of the pumps. An eductor may also be used as a means of introducing liquid to the chips. For example, an eductor may be located in the outlet of or beneath vessel 226 and liquid first introduced to the chips by means of this eductor. The eductor may comprise a venturi-type orifice in one or more conduits 250, 252, and 234 into which a pressurized stream of liquid is introduced. This pressurized liquid may be obtained from any available source but is preferably obtained from conduit 235, upstream of valve 58. An exemplary eductor is shown schematically at 70 in FIG. 3.

The pumps 251 and 251' need not be centrifugal pumps but may be any other form of slurry transfer device that can directly act on to pressurize and transfer a slurry of chips and liquor from the outlet of vessel 226 to the inlet of digester 11. For instance, a solids pump as typically used in the mining industry may be used; for example, a double-piston solids pump such as the KOS solids pump sold by Putzmeister, or any other similar conventional pumping device may be used.

One function of the prior High-Pressure Feeder 27 of FIGS. 1 and 2 is to act as a shut-off valve to prevent possible escape of the pressure in the equipment and transfer conduits, for example, conduits 34 and 35 of FIG. 1, should any of the feed components malfunction or fail. In the feed system 210 according to the present invention, alternative means are provided to prevent such release of pressure due to malfunction or failure. For example, FIG. 3 illustrates a one-way (check) valve 65 in conduit 234 to prevent pressurized flow from returning to pump 251 or 251'. In addition, conventional automatic (e.g. solenoid operated) isolation valves 66 and 67 are located in conduits 234 and 235, respectively, to isolate the pressurized conduits 234, 235 from the rest of the feed system 210. In one preferred mode of operation, a conventional pressure switch 68 is located downstream of pump 251' in conduit 234. The switch 68 is used to monitor the pressure in line 234 so that should the pressure deviate from a predetermined value, the conventional controller 69 will automatically isolate digester 11 from feed system 210 by automatically closing valves 66 and 67. These valves may also be automatically closed when a flow direction sensor detects a reversal of flow in conduit 234.

While the pressure release preventing means 65–69 described above is preferred, other arrangements of valves, sensors, indicators, alarms, or the like may comprise the pressure release preventing means as long as such arrangements adequately perform the function of preventing significant depressurization of the digester 11.

While the system 210 is preferably used with a continuous digester 11, it also may be used with other vertical superatmospheric (typically a pressure of at least about 10 bar gauge) treatment vessels having a top inlet, such as an impregnation vessel or a batch digester.

Figure 4:
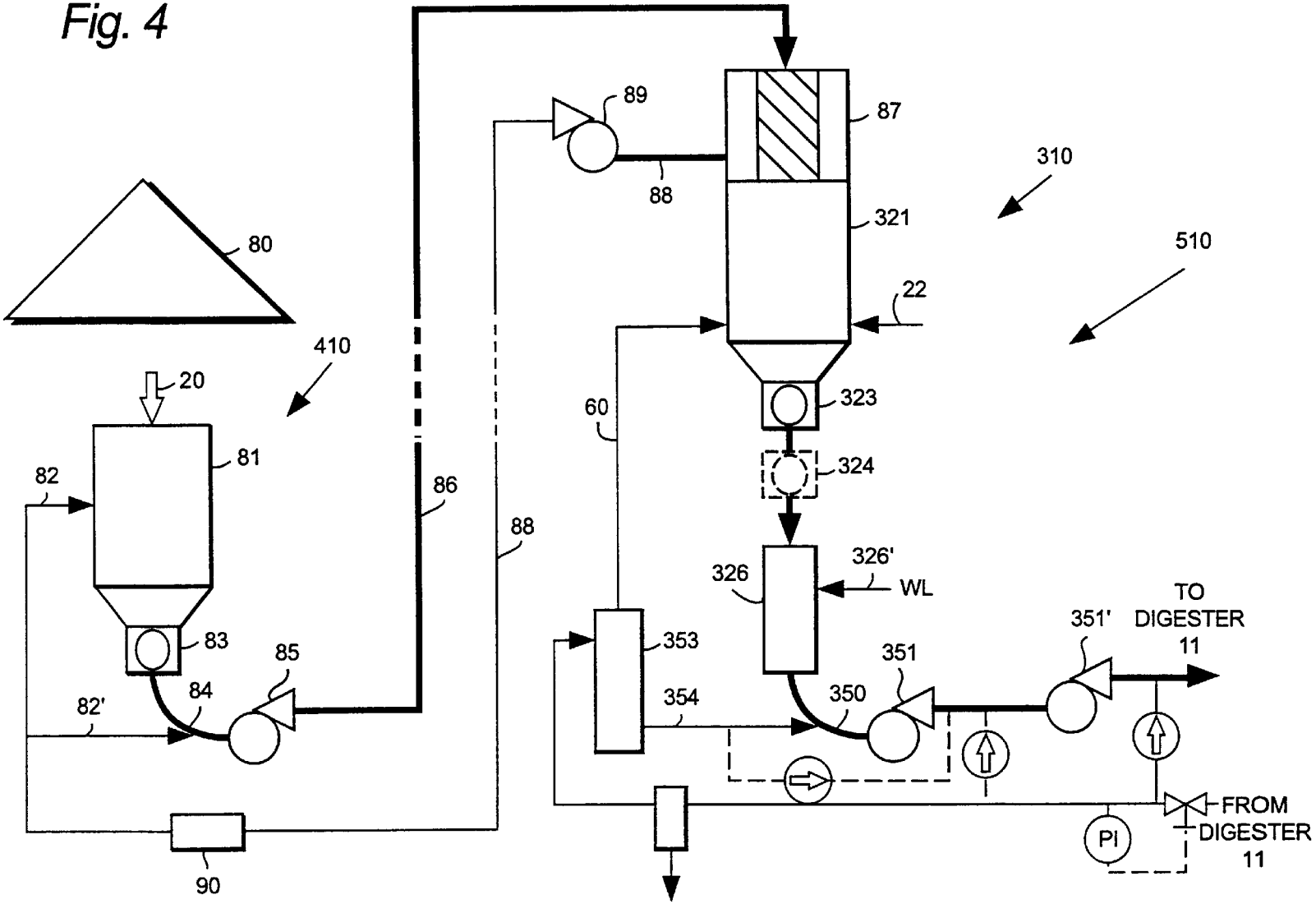
FIGS. 4 and 5 illustrate two other embodiments of systems according to the invention.

FIG. 4 illustrates a further embodiment of this invention in which the concept of transferring chips is extended from the feed system of a digester to the Woodyard of a pulp mill. FIG. 4 illustrates a system 510 for feeding comminuted cellulosic fibrous material to a pulping process. It consists of a subsystem 410 for introducing chips from the Woodyard to system 510 and a subsystem 310 for treating and feeding chips to digester 11. Subsystem 310 is essentially identical to the system 210 shown in FIG. 3.

Again, the components in FIG. 4 which are identical to those that appear in FIGS. 1–3 are identified by the same reference numbers. Those components which are similar or which perform similar functions to those that appear in FIGS. 1–3 have their reference numbers that appear in FIG. 1 prefaced by the numeral "3".

The Woodyards of conventional pulp mills receive their wood supply in various forms as described above. Typically, the wood, or other comminuted cellulosic fibrous material, is converted to chip like form and stored either in open chip piles or in chip storage silos. In FIG. 4 the chip supply is shown as chip pile 80. In a preferred embodiment of this invention the chips from pile 80 or some other storage vessel are conveyed by conventional means, e.g., a conveyor or front-end loader (not shown), and introduced 20 to vessel 81. This vessel may be a DIAMONDBACK vessel or any other conventional storage vessel. Vessel 81 may be operated at superatmospheric pressure, for example at 0.1 to 5 bar. If the vessel is operated at superatmospheric pressure, some form of pressure isolation device (not shown) may be located at the inlet of the vessel to prevent the release of pressure. This device may be a star-type isolation device, such as a Low-pressure Feeder or Air-lock Feeder as sold by Ahlstrom Machinery, or a screw-type feeder having a sealing capacity as described in co-pending application Ser. No. 08/713,431.

Liquid, for example fresh water, steam, liquids containing cooking chemicals is introduced to vessel 81 via one or more conduits 82 to produce a slurry of liquid and chips and to provide a detectable liquid level in vessel 81. Means for monitoring and controlling the level of the liquid, and the level of the chips, in vessel 81 may be provided. This liquid may be a heated liquid, for example, hot water or steam, having a temperature of between 50 and 100° C. If the vessel is a pressurized vessel, liquid temperatures of over 100° C. may be used. Preferably, though not essentially, this liquid may contain at least some active pulping chemical, for example, sodium hydroxide (NaOH), sodium sulfide (Na2S), polysulfide, anthraquinone or their equivalents or derivatives or surfactants, enzymes or chelants, or combinations thereof.

From vessel 81, the slurry is discharged to the inlet of slurry pump 85 via conduit 84. The discharge from vessel 81 may be aided by a discharge device 83 (probably not necessary if a DIAMONDBACK® discharge is used). The flow of slurry in conduit 84 may also be aided by the addition of liquid via conduit 82'. The conduit 82' may be the only mechanism for introducing liquid, so that a liquid level is present in conduit 84 or not in vessel 81. Pump 85 may be any type of slurry pump discussed above, for example, a Wemco or Lawrence pump or their equivalents, any other type of solids or slurry transfer device. Though only one pump 85 is shown, more than one pump or similar devices may be used to transfer the slurry via conduit 86 to vessel 321. The slurry transfer via conduit 86 may include one or more storage or surge tanks (not shown). Preferably, the one or more pumps 85 include at least one device having de-gassing capability so that undesirable air or other gases may be removed from the slurry.

The slurry discharged from pump 85 is transferred via conduit 86 to subsystem 810. Subsystem 810 may be located adjacent subsystem 710, that is, within about 30 feet of subsystem 710, or may be spaced an appreciable distance from subsystem 710, for example one-half mile or more away, depending upon the layout of the pulp mill. Hence, conduit 86 is broken to indicate an undetermined distance between subsystem 710 and subsystem 810.

The pressure in conduit 86 is dependent upon the number of pumps and other transfer devices used and the height and distance that the slurry must be transferred. The pressure in conduit 86 may vary from about 5 psig to over 500 psig.

Also, during transfer, the chips may be exposed to some form of treatment, for example, de-aeration or impregnation with a liquid, preferably a liquid containing pulping chemicals, such as those described above. The slurry may also be exposed to at least one pressure fluctuation during transfer, such that the pressure of the slurry is varied from a first pressure to a second, higher pressure, and then to a third pressure which is lower than the second pressure. As described in U.S. Pat. Nos. 4,057,461 and 4,743,338 varying the pressure of a slurry of chips and liquor improves the impregnation of the chips with the liquor. This pressure pulsation may be achieved via varying the outlet pressure of a set of transfer devices in series, or by controlled depressurization of the slurry between pumping.

The slurry in conduit 86 is introduced to the inlet of vessel 321. Though the vessel shown is a treatment, i.e., steaming, vessel, it may also be a storage vessel, an impregnation vessel, or even a digester. Since the transfer in conduit 86 typically requires that at least some excess liquid, that is not needed during treatment or storage, some form of de-watering device 87 may be located between the transfer device and the treatment vessel. One preferred dewatering device is a Top Separator, as sold by Ahlstrom Machinery. This Top Separator may be a standard type or an "inverted" Top Separator. This device may be an external stand-alone-type unit or one that is mounted directly onto the treatment vessel, as shown. Preferably, the liquid removed from the slurry by means of de-watering device 87 is returned to vessel 82 or to the inlet of the pump, or pumps, 85 via conduit 88 to aid in slurrying the chips. This liquid removed via device 87 may also be used where ever needed in the pulp mill. This liquid in conduit 88 may be heated or cooled as desired in a heat exchanger 90 and may be pressurized using one or more conventional centrifugal liquid pumps, 89. The liquid in conduit 88 may be introduced to vessel 81 via conduit 82 and to conduit 84 via conduit 82'.

The treatment vessel 321 shown is a steaming vessel similar to vessel 221 shown in FIG. 3, for example a DIAMONDBACK steaming vessel. The feed system 310 is otherwise similar to the system 210 shown in FIG. 3. For example, chip feeding system 410, feeds digester feed system 310, which feeds digester 11. Note that system 310 of FIG. 4 is simply one subsystem in the over-all system which feeds chips from the chip pile 80 to the digester 11. This system may include one or more subsystems 310 for feeding to digester 11.

Figure 5:
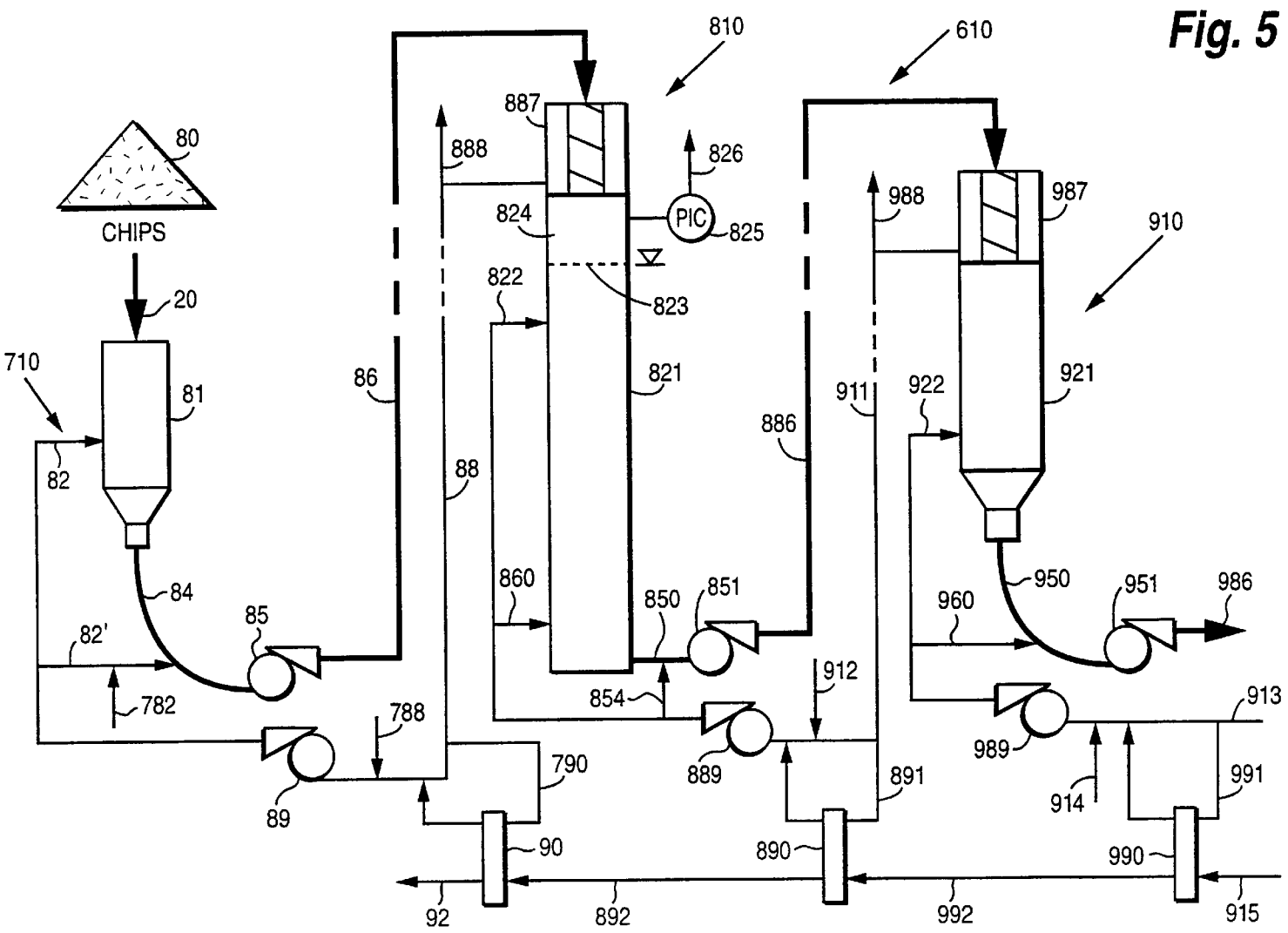

FIG. 5 illustrates a further embodiment 610 of this invention that is an extension of the system 510 shown in FIG. 4. The system 610 is a combination of three subsystems 710, 810 and 910. Subsystem 710 is similar to the system 410 of FIG. 4. Items in FIG. 5 that are essentially identical to those found in FIGS. 1 through 4 are identified by the same numbers.

Wood chips 20, or some other comminuted cellulosic fibrous material, from chip pile 80 are introduced with or without pressure isolation to vessel 81. The chips in vessel 81 may be treated with a gas, such as steam or hydrogen sulfide, or a liquid, such as water or a liquid containing cooking chemical, introduced by way of one or more conduits 82. Vessel 81 may be any type of vessel, but is preferably a DIAMONDBACK® bin; as described above. The treated chips are discharged from vessel 81 into conduit 84. Though any type of discharging mechanism can be used, the discharge of chips from vessel 81 is preferably performed without the aid of mechanical agitation or vibration, as is characteristic of DIAMONDBACK® chips bins. Conduit 84 may be any type of pipe or chute but is preferably a curved Chip Tube as described above.

Conduit 84 introduces the chips to the inlet of slurry pump 85, which may be of the type supplied by Wemco or Lawrence, as described above. Typically, slurrying liquid is preferably first introduced to the chips in conduit 84, for example, using the conduit 82', to produce a level of liquid in vessel 81 or conduit 84. The liquid introduced via conduit 82', may be water or a liquid containing treatment chemicals such as kraft liquors, with or without strength or yield enhancing additives. Make-up liquor, for example, liquor containing these chemicals, is typically added via conduit 782.

The slurry in conduit 86 is introduced to subsystem 810 via liquor separating device 887, which is similar in operation to device 87 shown in FIG. 4. The liquid removed via separator 887 can be returned to subsystem 710 via conduit 88 or can be used elsewhere in the pulp mill via conduit 888. If returned to subsystem 710 via conduit 88 the liquor may be augmented with additional liquid or chemical via conduit 788, heated via indirect heat exchanger 90 via conduit 790 and pressurized by pump 89 prior to being re-introduced to vessel 81 via conduit 82 or to conduit 84 via conduit 82'. Subsystem 710 may also include a liquor storage tank similar to tank 353 shown in FIG. 4. Thus by the use of heater 90 and chemical addition 782 or 788, the slurry of material transferred from subsystem 710 to subsystem 810 via conduit 86 may be heated to any desirable temperature while being treated with chemicals. For example, if the slurry in conduit 86 is heated to about 90° C. or above in the presence of alkali or sulfide, some pretreatment of the will occur during the retention time in conduit 86 prior to introduction of the slurry into subsystem 810. Of course, lower temperatures and other chemicals may also be used in conduit 86.

The chips retained by separator 887 are passed to vessel 821. Vessel 821 may be a vessel similar to vessel 81, but is preferably a tall cylindrical vessel, for example, 20 to 50 feet tall, in which a liquid level 823 is maintained. A gas space 824 may be maintained above level 823. Vessel 821 may be maintained at atmospheric pressure or at superatmospheric pressure, for example, at 0.2 to 10 bar gauge pressure (e.g. about 5 bar), depending on the treatment performed in vessel 821. The temperature in vessel 821 may vary from 50 to 300° C., but is typically between about 50 and 150° C. Liquid may be introduced to vessel 821 via one or more conduits 822 or 860. This liquid may contain cooking chemicals or additives as discussed above. These cooking chemicals or additives may be the same as those introduced in subsystem 710 or they may be different. For example, kraft cooking liquor containing a high concentration of sulfide ion or sulfidity may be introduced to subsystem 710 and kraft cooking chemical containing a lower concentration of sulfide ion or sulfidity may be introduce to the chips in subsystem 810. In another example, a polysulfide-type additive may be introduced to the chips in subsystem 710 and an anthraquinone-type additive may be introduced in subsystem 810.

The pressure within the vessel 821 may be monitored and controlled via pressure indicator and controller 825. Excess pressure may be released via conduit 826, for example, to a conventional non-condensable gas (NCG) treatment system or to vessel 81 for pretreatment. In addition, the pressure controller 825 can be used to regulate the pressure in vessel 821 to vary the pressure to effect pressure pulsation impregnation as described in U.S. Pat. Nos. 4,057,461 and 4,743,338.

The slurry is discharged from vessel 821 to conduit 850. This discharge may be effected without agitation or vibration as in a DIAMONDBACK chip bin, or it may be effected by agitation or vibration as is conventional. Conduit 850 introduces the slurry to the inlet of pump 851, which may be similar to pump 85, but typically will have a higher pressure rating. Additional liquid may be introduced to conduit 850 via conduit 854 to aid in introducing the slurry to the pump 851. The slurry discharged from pump 851 is passed to subsystem 910 via conduit 886.

The slurry in conduit 886 is introduced to subsystem 910 using the liquor separating device 987. The separator 987 is similar to devices 887 and 87 (of FIG. 4). The liquor removed from device 987 may be returned by conduit 911 to subsystem 810 or may be used elsewhere in the pulp mill via conduit 988. If returned to subsystem 810 via conduit 911, the liquor may be augmented with additional liquid or chemical via conduit 912, heated via indirect heat exchanger 890 via conduit 891 and pressurized by pump 889 prior to being re-introduced to vessel 821 via conduit 822 or 860 to conduit 850 via conduit 854. The liquor in conduit 911 may also be introduced to subsystem 710, for example, via a common connection with conduit 88 or 82. Subsystem 810 may also include a liquor storage tank similar to tank 353 shown in FIG. 4. Thus by using heater 890 and chemical addition 912, the slurry of material transferred from subsystem 810 to subsystem 910 via conduit 886 may be heated to any desirable temperature while being treated with chemicals. For example, if the slurry in conduit 886 is heated to about 90° C. or above in the presence of alkali or sulfide, some pretreatment of the material will occur during the retention time in conduit 886 prior to introduction of the slurry into subsystem 910. Of course, lower temperatures and other chemicals may also be used in conduit 886.

The chips retained by separator 987 are passed to vessel 921, which may be a vessel similar to vessels 81, or a tall vessel similar to vessel 821, or a vessel similar to vessel 321 of FIG. 4. Vessel 921 may be maintained at atmospheric pressure, or at super-atmospheric pressure [for example, at 0.2 to 10 bar gauge, preferably 0.5 to 5 bar gauge pressure] depending on the treatment performed in vessel 921. The temperature in vessel 921 may vary from 50 to 300° C., but is typically between about 50 and 150° C., preferably between about 80 and 120° C. Liquid may be introduced to vessel 921 via one or more conduits 922 or 960. The introduced liquid may contain cooking chemicals or additives as discussed above. These cooking chemicals or additives may be the same as those introduced in subsystem 710 or 810 or they may be different. For example, kraft cooking liquor containing a high concentration of sulfide ion or sulfidity may be introduced to subsystem 810 and kraft cooking chemical containing a lower concentration of sulfide ion or sulfidity may be introduced to the chips in subsystem 910. In another example, a polysulfide-type additive may be introduced to the chips in subsystem 710 and an anthraquinone-type additive may be introduced in subsystem 810, and kraft white liquor may be introduced to the chips in subsystem 910. Each or these liquors can be isolated from each other by the liquor separators 887 and 987.

The slurry is discharged from vessel 921 to conduit 950. This discharge may be effected without agitation or vibration using a discharge as in a DIAMONDBACK® chips bin, or it may be aided by agitation or vibration as is conventional. Conduit 950 introduces the slurry to the inlet of pump 951, which may be similar to pumps 85 and 851, but typically will have a higher pressure rating. Additional liquid may be introduced to conduit 950 via conduit 960 to aid in introducing the slurry to the pump 951. The slurry discharged from pump 951 is passed to further treatment via conduit 886, for example, to a digester (that is, a continuous or batch digester), or to further treatment in a subsystem similar to subsystems 810 or 910, or subsystem 310 of FIG. 4. However, the treatment effected in subsystems 710, 810 and 910 may be sufficient to produce an essentially fully-cooked pulp slurry in conduit 950 such that no further "pulping" need be performed. The pulp in conduit 950 may be passed directly to washing and/or bleaching.

As in subsystems 310, 810, and 910, excess liquor may be returned to subsystem 910 via conduit 913. The liquor may be augmented with additional liquid or chemical via conduit 914, heated via indirect heat exchanger 990 via conduit 991 and pressurized by pump 989 prior to being re-introduced to vessel 921 via conduit 922 or to conduit 950 via conduit 960. The liquor in conduit 913 may also be introduced to subsystem 710 or 810, for example, via a common connection with conduit 88 or 82 (not shown) or a common connection with conduits 911 or 822, or similar conduits. Subsystem 910 may also include a liquor storage tank similar to tank 353 shown in FIG. 4.

Thus, using heater 990 and chemical addition 914, the slurry of material transferred from subsystem 910 to the subsequent subsystem or digester via conduit 986 may be heated to any desirable temperature while being treated with chemicals. For example, if the slurry in conduit 986 is heated to about 90° C. or above in the presence of alkali or sulfide, some pretreatment of the chips will occur during the retention time in conduit 986 prior to introduction of the slurry into the subsequent treatment device, for example to digester 11 of FIGS. 1 and 2. Of course, lower or higher temperatures and other chemicals may also be used in conduit 986.

Also, though indirect heat exchangers 90, 890, and 990 may each be supplied by their own separate source of heat, for example, separate sources of steam or hot water or hot effluent that would normally be discharged, heat exchangers 90, 890 and 990 may also be supplied with a common source of heat 915. The source of heat 915 may be, for example, hot effluent or steam (low, medium or high pressure steam), and may be introduced to heat exchanger 990 and the residual heat transferred to heat exchanger 890 via conduit 992. The residual heat from heat exchanger 890 may be passed to heat exchanger 90 via conduit 892. Any residual heat remaining in conduit 92 may be used as needed in systems 710, 810 or 910 or elsewhere in the mill, or it may be discarded. For example, the liquid in conduit 92, and any residual heat it may contain, may be introduced to vessel 81 or 821 via conduits 82 or 822 to recover and re-use as much of the available energy as possible.

Using a system 610 as shown in FIG. 5, a counter-current flow of treatment liquids can be established between each subsystem. For example, the liquid from upstream treatment can be returned to subsystem 910 via conduit 913; the liquid from subsystem 910 can be returned to subsystem 810 via conduit 911; and the liquid from subsystem 810 can be returned to subsystem 710 via conduit 88. In addition some or all of these liquors can be removed and used elsewhere via conduits 888 and 988.

The chemical addition at 788, 912, and 914 is preferably sodium hydroxide, sodium sulfide; polysulfide, anthraquinone or their equivalents or derivatives; surfactants, enzymes, or chelants; or combinations thereof. For example, different treatment chemicals could be added at each of 788, 912, and 914, so that different treatments take place in each of the sections 710, 810, and 910. For example, polysulfide may be added at 788, anthraquinone at 912, and chelants and enzymes at 914. The conduits at 788, 912, 914 need not be provided where illustrated in FIG. 5, but may be provided at any convenient location which facilitates impregnation, or other pretreatment, simultaneously with transport. For example, lines 788, 912, 914 may be added to the lines 790, 891, 991 before the heater exchangers 90, 890, 990, respectively.

Figure 6:
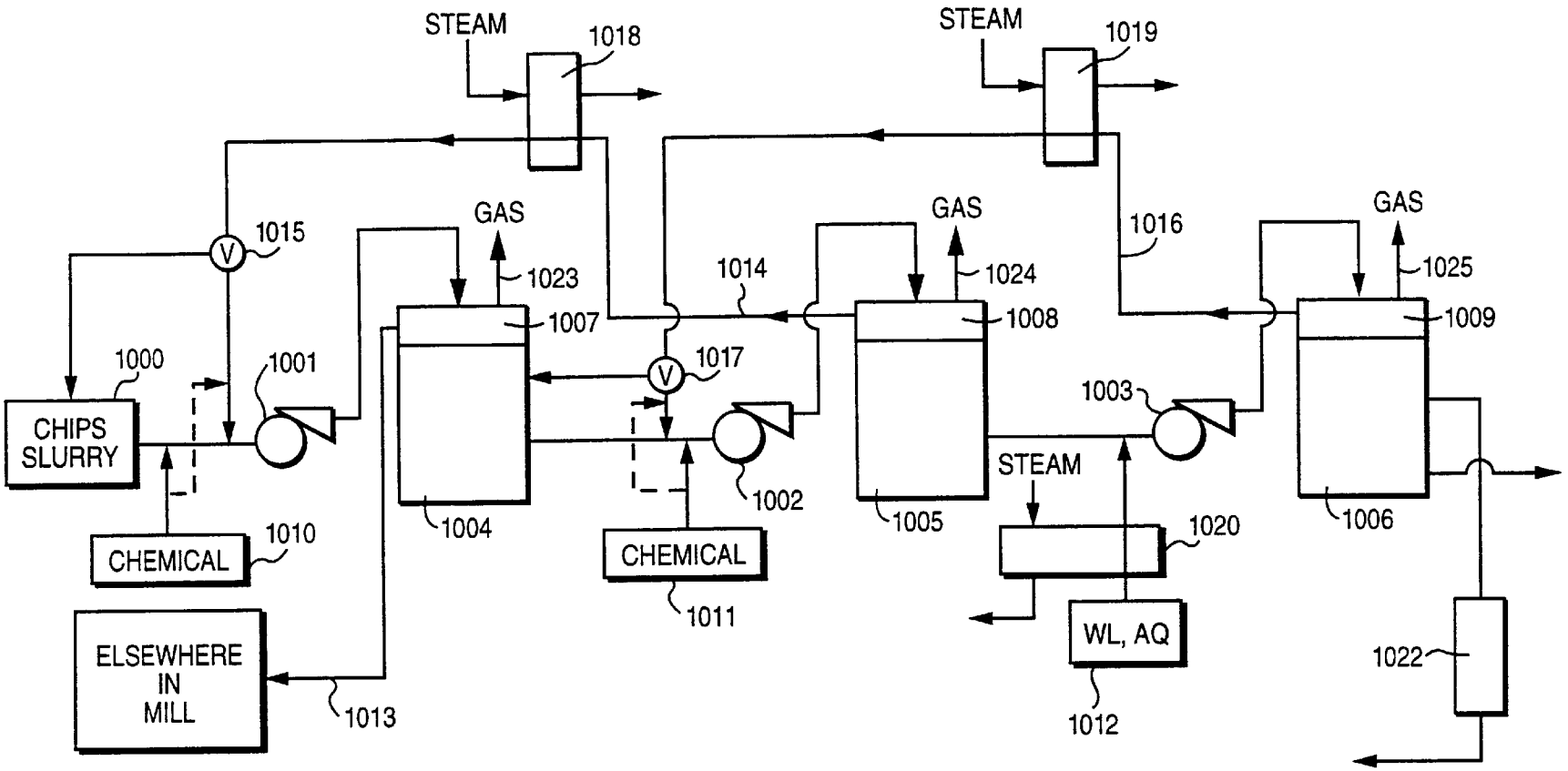
FIG. 6 is a schematic representation of another system that may be used for practicing a method according to the invention.

FIG. 6 schematically illustrates other apparatus according to the invention, for practicing a method according to the invention. Utilizing the system of FIG. 6 a slurry of comminuted cellulosic fibrous material (typically at a consistency of about 5–20%) is transported within a pulp mill at any locations within a fiber line, such as from the wood yard to a digester, with intermittent booster pumps in series. Each pump is associated with a station (treatment vessel) and a solids/ liquid separator is associated with each station (typically a conventional solid/liquid separator at the top of the station), to isolate liquor streams or circulations. Impregnation, or other pretreatment, is performed simultaneously during transit of the material, in the circulation lines (that is from one pump to its associated station), and the lines can be made very long (e.g. more than 100 yards, up to about a half a mile) to facilitate that pretreatment and impregnation. Preferably heat exchangers are utilitzed on the return lines, and degassing may be provided at one, more than one, or all of the transfer stations. Also, an eductor (ejector) can be used in place a flash tank and/or control valves through which liquor is removed and pressure reduced. Further, pressurized pulsation action may be associated with the configuration of pumps and stations, the pumps pressurizing the slurry to at least 5 bar (typically at least about 10 bar). Also, a wide variety of treatment chemicals may be utilized preferably added upstream of the pumps, including sodium hydroxide, sodium sulfide; polysulfide, anthraquinone or their equivalents or derivatives; surfactants, enzymes, or chelants; or combinations thereof.

The chip slurry 1000 is formed in any conventional manner (including by heat steam slurrying), and first, second and third booster pumps 1001, 1002, and 1003 are connected in series. The pumps 1001–1003 are associated with stations (vessels) 1004, 1005, 1006, respectively. Preferably each of the stations 1004–1006 has a liquid/solid separator associated therewith. In the embodiment illustrated in FIG. 6 separators 1007, 1008, 1009 are shown mounted at the top of each of the stations (treatment vessels) 1004–1006, although the separator could be at another location, including the bottom.

Preferably chemical is added to the slurry at a number of different locations in the system, such as upstream at each of the pumps 1001–1003. This is schematically illustrated by chemical addition at points 1010, 1011, and 1012 in FIG. 6. The same, or different, chemicals can be added at each of 1010–1012. Preferably at least some of the chemical includes sodium hydroxide, sodium sulfide; polysulfide, anthraquinone or their equivalents or derivatives; surfactants, enzymes, or chelants; or combinations thereof. In the embodiment actually illustrated in FIG. 6, the chemical addition 1012 includes AQ laden white liquor (e.g. vessel 1006 is a continuous digester).

Instead of establishing circulation lines such as illustrated in FIG. 5, circulation is provided in the FIG. 6 embodiment, in the preferred form, so as to cause pseudo counter-current flow of the comminuted cellulosic fibrous material and liquid. While FIG. 6 illustrates three stations, any number of stations may be provided. In the embodiment in FIG. 6, the liquid removed from the separator 1007 in line 1013, is used elsewhere in the mill, or treated for reuse. The liquid removed from separator 1008 passes in line 1014 to a point upstream of the pump 1001 (e.g. it is diverted by the valve 1015 either to the slurrying station 1000, or to the infeed to the pump 1001) while liquid separated by the third separator 1009 is circulated in line 1016 to upstream of the pump 1002, e.g. diverted by the valve 1017 to the first station 1004, and/or to just upstream of the pump 1002. Fresh liquor, from source 1012, is added to the bottom of the vessel 1005, or the intake of the pump 1003.

In the return lines 1014, 1016, conventional indirect heat exchangers 1018, 1019 may be provided which change the temperature of the liquid therein by at least 5° C. In the embodiment illustrated, the liquor is heated, but in some circumstances the liquid could be cooled instead of heated. A indirect heat exchanger 1020 may be also be associated with the chemical addition 1012.

Liquor can be passed from the third station 1006 (which may be a digester—e.g. black liquor) through a conventional eductor (ejector) 1022, rather than a flash tank and/or control valves. Each of the pumps 1001–1003 preferably pressurizes the slurry to a pressure of at least 5 bar (typically at least about 10 bar).

Degassing may also be associated with one, more than one, or all of the stations 1004. This is schematically illusrated by the gas removal lines 1023–1025 in FIG. 6. Degassing may be accomplished using any conventional degassing equipment, associated with the separator 1007–1009, the inlet line, or the like.

In the broadest aspect of this invention, a system and method are provided for the multistage transport and treatment of comminuted cellulosic fibrous material with the economical recovery and re-use of energy, including thermal energy.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of feeding wood chips to the top of a treatment vessel comprising the steps of:

(a) steaming the wood chips to remove air therefrom and to heat the wood chips;

(b) slurrying the wood chips with a cooking liquor to produce a slurry of liquid and wood chips;

(c) pressurizing the slurry at a location at least thirty feet below the top of the treatment vessel and transferring pressurized slurry to the top of the treatment vessel, said pressurizing step consisting of acting on the slurry with one or more high pressure slurry pumps; and (d) during the practice of the transferring step (c), treating the wood chips with polysuflide, anthraquinone or their equivalents or derivatives, surfactants, enzymes, chelants, or combinations thereof.

2. A method as recited in claim 1 wherein the treatment vessel is upstream of a continuous digester, and wherein step (c) is practiced upstream of the treatment vessel.

3. A method as recited in claim 2 comprising the further step (e), before the treatment vessel and substantially immediately after steps (a) and (b), of pressurizing the slurry at a location at least 30 feet below the top of the digester.

4. A method as recited in claim 2 wherein the treatment vessel comprising a first treatment vessel, and further comprising a second treatment vessel upstream of the first treatment vessel and downstream of where step (a) is practiced; and comprising the step of returning liquid removed from the first treatment vessel to the second treatment vessel, and adjusting the temperature of the liquid while returning it to the second treatment vessel.

5. A method as recited in claim 4 wherein the step of removing liquid from the first treatment vessel takes place at the top of the first treatment vessel.

6. A method as recited in claim 4 comprising the further step of returning liquid from downstream of the treatment vessel to the treatment vessel, and adjusting the temperature of the returning liquid.

7. A method as recited in claim 6 wherein said step of adjusting the temperature of the liquid takes place by passing the liquid through an indirect heat exchanger.

8. A method as recited in claim 4 comprising the further step of returning liquid separated from the slurry at the top of the first treatment vessel to the one or more slurry pumps pressurizing the slurry to transfer it to the first treatment vessel, and adjusting the temperature of the removed liquid during recirculation.

9. A method as recited in claim 1 wherein (c) is practiced to pressurize the slurry to a pressure of at least about 5 bar gauge.

10. A method as recited in claim 1 wherein the treatment vessel is upstream of one or more batch digesters, and wherein step (c) is practiced downstream of the treatment vessel.

11. A method as recited in claim 1 wherein step (c) is practiced by pressurizing the slurry with first and second series connected pumps.

12. A method of treating comminuted cellulosic fibrous material using at least first and second series connected pumps, and at least first and second in series stations each with a solids/liquid separator, comprising the steps of:

(a) pumping a slurry of comminuted cellulosic fibrous material using the series connected pumps;

(b) separating some liquid from the slurry at each station to substantially isolate liquor circulations and streams, and to recirculate removed liquid from at least one of the stations to upstream of one of the pumps; and (c) adding chemicals to the slurry upstream of each of the pumps, the chemicals including at least some chemical selected from the group consisting of sodium hydroxide, sodium sulfide; polysulfide, anthraquinone, or their equivalents or derivatives; surfactants, enzymes, or chelants; or combinations thereof; so that pre-treatment of the material occurs during transfer of the material from a pump to a station.

13. A method as recited in claim 12 comprising the further step of degassing the slurry at at least one of the stations.

14. A method as recited in claim 12 wherein at least first, second, and third series connected pumps and stations are provided; and comprising the further steps of: (d) circulating liquid removed from the third station to a location upstream of the second pump, and (e) circulating liquid removed form the second station to a location upstream of the first pump.

15. A method as recited in claim 14 wherein step (d) is practiced downstream of the first station.

16. A method as recited in claim 14 comprising the further step of passing the removed liquid, during the practice of at least one of steps (d) and (e), through a heat exchanger to change the temperature thereof at least about 5 degrees C.

17. A method as recited in claim 12 wherein step (c) is practiced by adding a different chemical, or combination of chemicals, upstream of each pump, so that significantly different treatments of the material of the slurry take place during transfer of the slurry from each pump to its associated station.

18. A method as recited in claim 12 wherein step (a) is practiced to pressurize the slurry to a pressure of at least 5 bar.

19. A method as recited in claim 12 comprising the further step of passing liquid from at least one of the stations using an ejector instead of a flash tank or control valve.

20. A method as recited in claim 12 wherein the comminuted cellulosic fibrous material is wood chips; and further comprising prior to (a), (d) steaming the wood chips to remove air therefrom and to heat the wood chips; (e) slurrying the wood chips with a cooking liquor to produce a slurry of liquid and chips; and wherein (c) is practiced by adding polysulfide, anthraquinone or other equivalents or derivatives, surfactants, enzymes, chelants, or combinations thereof.

21. A method of treating comminuted cellulosic fibrous material using at least first and second series connected pumps, and at least first and second in series stations associated with the at least first and second pumps, respectively, each with a solids/liquid separator, comprising the steps of:

(a) pumping a slurry of comminuted cellulosic fibrous material using the series connected pumps;

(b) separating some liquid from the slurry at each station to substantially isolate liquor circulations and streams, and to recirculate removed liquid from at least one of the stations to upstream of one of the pumps;

(c) adding treatment chemical to the slurry upstream of at least one of the pumps so that pre-treatment of the material occurs during transfer of the material from that pump to its associated station; and (d) circulating liquid removed form the second station to a location upstream of the first pump.

22. A method as recited in claim 21 using at least first, second and third series connected pumps and stations, and comprising the further step (e) of circulating liquid removed from the third station to a location upstream of the second pump.

23. A method as recited in claim 22 comprising the further step of passing the removed liquid, during the practice of at least one of steps (d) and (e), through a heat exchanger to change the temperature thereof at least about 5 degrees C.

24. A method as recited in claim 22 wherein step (c) is practiced by adding a different chemical, or combination of chemicals, upstream of each pump, so that significantly different treatments of the material of the slurry take place during transfer of the slurry from each pump to its associated station; and wherein step (a) is practiced to pressurize the slurry to a pressure of at least 5 bar.

25. A method as recited in claim 22 wherein step (e) is practiced downstream of the first station.

* * * * *